US007276000B1

(12) United States Patent
Baker

(10) Patent No.: US 7,276,000 B1
(45) Date of Patent: Oct. 2, 2007

(54) TRAINING GRIP FOR A TENNIS RACQUET

(76) Inventor: Michael B. Baker, 185 King George St., Daniel Island, SC (US) 29494

( * ) Notice: Subject to any disclaimer, the term of this patent is extended or adjusted under 35 U.S.C. 154(b) by 0 days.

(21) Appl. No.: 11/480,211

(22) Filed: Jul. 3, 2006

Related U.S. Application Data

(60) Provisional application No. 60/696,241, filed on Jul. 1, 2005.

(51) Int. Cl.
*A63B 69/38* (2006.01)
*A63B 49/08* (2006.01)

(52) U.S. Cl. ..... 473/459; 473/463; 473/551

(58) Field of Classification Search ..... 473/549, 473/551, 568, 459–464, 300, 302, 303
See application file for complete search history.

(56) References Cited

U.S. PATENT DOCUMENTS

| | | | | |
|---|---|---|---|---|
| 1,917,236 | A * | 7/1933 | Bloomstrand | 434/247 |
| 2,628,100 | A * | 2/1953 | Beebe | 473/203 |
| 3,868,110 | A * | 2/1975 | Jones | 473/551 |
| 3,905,598 | A * | 9/1975 | Ballog | 473/538 |
| 4,360,201 | A | 11/1982 | Biehl | |
| 4,765,856 | A * | 8/1988 | Doubt | 156/212 |
| 4,836,544 | A * | 6/1989 | Lai | 473/551 |
| 4,943,058 | A * | 7/1990 | Carbonetti | 473/551 |
| 5,155,878 | A | 10/1992 | Dellis | |
| 5,403,008 | A * | 4/1995 | Mainiero | 473/201 |
| 5,657,985 | A * | 8/1997 | Dahlstrom et al. | 473/523 |
| 5,730,662 | A * | 3/1998 | Rens | 473/300 |
| 5,924,941 | A * | 7/1999 | Hagey | 473/551 |

(Continued)

FOREIGN PATENT DOCUMENTS

| | | | |
|---|---|---|---|
| GB | 2202153 | A | 9/1988 |

(Continued)

OTHER PUBLICATIONS

Webpage De Golden Grip from http.//www.degoldenfrip.com dated Jan. 5, 2007; Author unknown.

*Primary Examiner*—Raleigh W. Chiu
(74) *Attorney, Agent, or Firm*—Angelica M. Colwell; Nexsen Pruet, LLC

(57) ABSTRACT

A training grip that can be installed onto a tennis racquet handle for positioning a tennis player's hand or hands correctly on the racquet to teach or train the player individual tennis strokes. The training grip is adapted to be easily and removably installed onto the eight-sided handle of a tennis racquet directly over an existing grip that is permanently affixed to the racquet. The training grip is an elongated cup having a slit that runs lengthwise from the first end of the grip to the opposing second end of the grip and through the bottom of the grip through which the grip may be installed onto the racquet handle. The outer surface of the grip is molded to have ridges and depressions creating contours for receiving and positioning the player's fingers and thumbs of the player's hand or hands. The grip is used to teach or train the player on the proper hand positioning for various methods of holding the tennis racquet commonly used to achieve various tennis strokes including the Continental Forehand, the Semi-Western Forehand, the Western Forehand, the Eastern Backhand, and the Two-Handed Backhand.

10 Claims, 3 Drawing Sheets

U.S. PATENT DOCUMENTS

| | | | | |
|---|---|---|---|---|
| 5,984,795 | A | 11/1999 | Stafford | |
| 6,213,902 | B1 * | 4/2001 | Hagey et al. | 473/551 |
| 2002/0132678 | A1 | 9/2002 | Matzie | |
| 2003/0207717 | A1 | 11/2003 | Ulrich | |
| 2006/0135295 | A1 * | 6/2006 | Szelenyi | 473/519 |

FOREIGN PATENT DOCUMENTS

| | | | |
|---|---|---|---|
| GB | 2334219 | A | 8/1999 |
| WO | WO 85/04592 | | 10/1985 |
| WO | WO 87/02899 | | 5/1987 |
| WO | WO 99/47214 | | 9/1999 |

* cited by examiner 12
13
14
18
20
22
25
26
28
30
31
32
33
35
37
40
2A
2B
2C
2D
2E 12
13
14
18
20
26
27
28
31
32
35
37
3A
3B
3C
3D
3E

TRAINING GRIP FOR A TENNIS RACQUET

CROSS REFERENCE TO RELATED APPLICATIONS

Applicant claims the priority benefit of U.S. provisional patent application Ser. No. 60/696,241, "TENNIS GRIP," filed Jul. 1, 2005, which is incorporated in its entirety herein.

BACKGROUND OF THE INVENTION

A tennis racquet is comprised of a frame that defines the racquet handle and racquet face, strings that are attached to the area of the frame that defines the racquet face and are woven to produce the actual face of the racquet used to hit a tennis ball, and at least one layer of a thin, flexible natural or synthetic material that is applied around the handle end of the racquet frame so that a tennis player can comfortably and securely hold onto the racquet. The outermost layer of material applied to the handle end of the tennis racquet is generally permanently affixed to the tennis racquet handle and commonly referred to as the "grip" of the racquet.

However, tennis players also use the term "grip" in reference to where a player places one or both of his or her hands onto the tennis racquet handle to hold onto the racquet for the play of tennis. How the player holds the racquet determines the angle of the racquet face and, therefore, how the strings comprising the face of the racquet contact the tennis ball during a stroke or shot. In a forehand stroke, the player holds the tennis racquet in one hand and swings the racquet with the palm of his or her hand coming toward the ball or facing his or her opponent. A backhand stroke may be defined as the forehand's opposite, meaning that the stroke is made with the back of the player's hand turned toward the opponent. However, a backhand stroke may be made with the player holding the tennis racquet in one or both of his or her hands. With a two-handed backhand, it is the back of the player's leading hand, or the hand that crosses the player's body, that comes toward the ball or faces the opponent during the stroke or shot.

There are several grips commonly used by tennis players to achieve various strokes used during the play of tennis. The Continental Forehand grip is a one-handed grip used primarily for serves, volleys, overheads, slices and defensive shots. The Western and Semi-Western Forehand grips are one-handed grips. The Semi-Western grip allows the player to hit topspin on the ball with his or her forehand which results in a more controlled and safer shot. The Eastern Backhand grip is a one-handed grip that can be used for a kick serve or to hit a one-handed backhand. Finally, the Two-Handed Backhand grip is used to hit the ball back-handed with both hands on the tennis racquet. In this grip, the right hand is placed in the Continental Forehand position and the left hand in the same position as used for the Semi-Western Forehand.

Students of tennis learn the different grips by repeating strokes to hit balls over and over again to learn how to direct the ball across the court. Such practice establishes a memory in the player's hand muscles for the feel of the racquet handle in the player's hand and in the player's brain for the speed and direction that can be put on the ball during the different shots.

Clearly, it is important for tennis players to learn proper positioning of their hand or hands for certain strokes, on the racquet handle. Players should be able to gain muscle memory for the different grips more quickly if proper hand placement is used for the first stroke of the racquet and every practice stroke subsequently taken while learning and practicing tennis shots. If a player could ensure that he or she was consistently obtaining a proper grip on the racquet when practicing individual strokes, it should also be easier for a player to improve the accuracy of their shots.

A number of training grips having ridges and/or depressions for guiding a player's hand, fingers and thumb into proper positioning have been developed for golf clubs, such as those disclosed by U.S. Pat. No. 1,664,257 to McCullough, U.S. Pat. No. 5,588,921 to Parsick, U.S. Pat. No. 5,524,892 to Karp, U.S. Pat. No. 1,855,126 to Connell, U.S. Pat. No. 5,299,802 to Brouchet-Lassale, U.S. Pat. No. 5,626,527 to Eberlein, and U.S. Pat. No. 5,984,795 to Stafford. Training grips for teaching the hand positioning for different grips used during the play of tennis were not specifically located.

Thus, there is a need for a way to train tennis players on proper hand and finger placement to achieve various grips used in tennis. There is also need for a training grip that can be easily and removably installed over the existing grip on a tennis racquet handle, that the user can ensure is correctly positioned on the racquet handle to obtain proper hand positioning for the main tennis grips, and that is constructed of a material thin enough that the grip does not interfere with the feel of the tennis racquet handle in the player's hand so that a memory may be established in the player's hand muscles of the hand placement used for a particular grip on the racquet handle.

SUMMARY OF THE INVENTION

According to a first embodiment and briefly recited, the present invention relates to a training grip that can be placed over an existing grip that is permanently affixed to the handle of a tennis racquet for positioning a tennis player's hand or hands correctly on the racquet to teach or train the player on various methods commonly used to grip the tennis racquet and perform various tennis strokes. The training grip is an elongated cup adapted to be easily and removably installed onto the eight-sided handle of a tennis racquet directly over the existing grip that is permanently affixed to the racquet. It is installed onto the racquet handle through a slit that runs lengthwise from the first end of the grip to the opposing second end and through the bottom of the grip. The outer surface of the grip is molded to have ridges and depressions creating contours for receiving and placing the fingers and thumbs of the player's hand or hands into positions commonly used to achieve various tennis strokes including the Continental Forehand, the Semi-Western Forehand, the Eastern Backhand, and the Two-Handed Backhand.

An important feature of the present invention is that the training grip can be easily installed onto and removed from a tennis racquet, and includes guide lines or match lines which ensure proper and consistent placement of the grip onto the racquet and, in turn, the player's hand on the racquet handle.

Another important feature of the present invention is the contours molded into the outer surface of the grip. The contours guide placement of the player's hand, fingers and thumb onto the racquet into the correct grip position for a particular stroke.

Still another feature of the present invention is that it is composed of a material thin enough so as not to interfere with the feel of the tennis racquet handle in the player's hand. It is important for the player to learn the feel of the actual handle with his or her hand in the correct position on the racquet so that he or she will be able to replicate the hold for each of the four main grips once the invention is removed.

These and other features and their advantages will be apparent to those skilled in the art of tennis from a careful reading of the Detailed Description of Preferred Embodiments accompanied by the following drawings.

Figure 1:
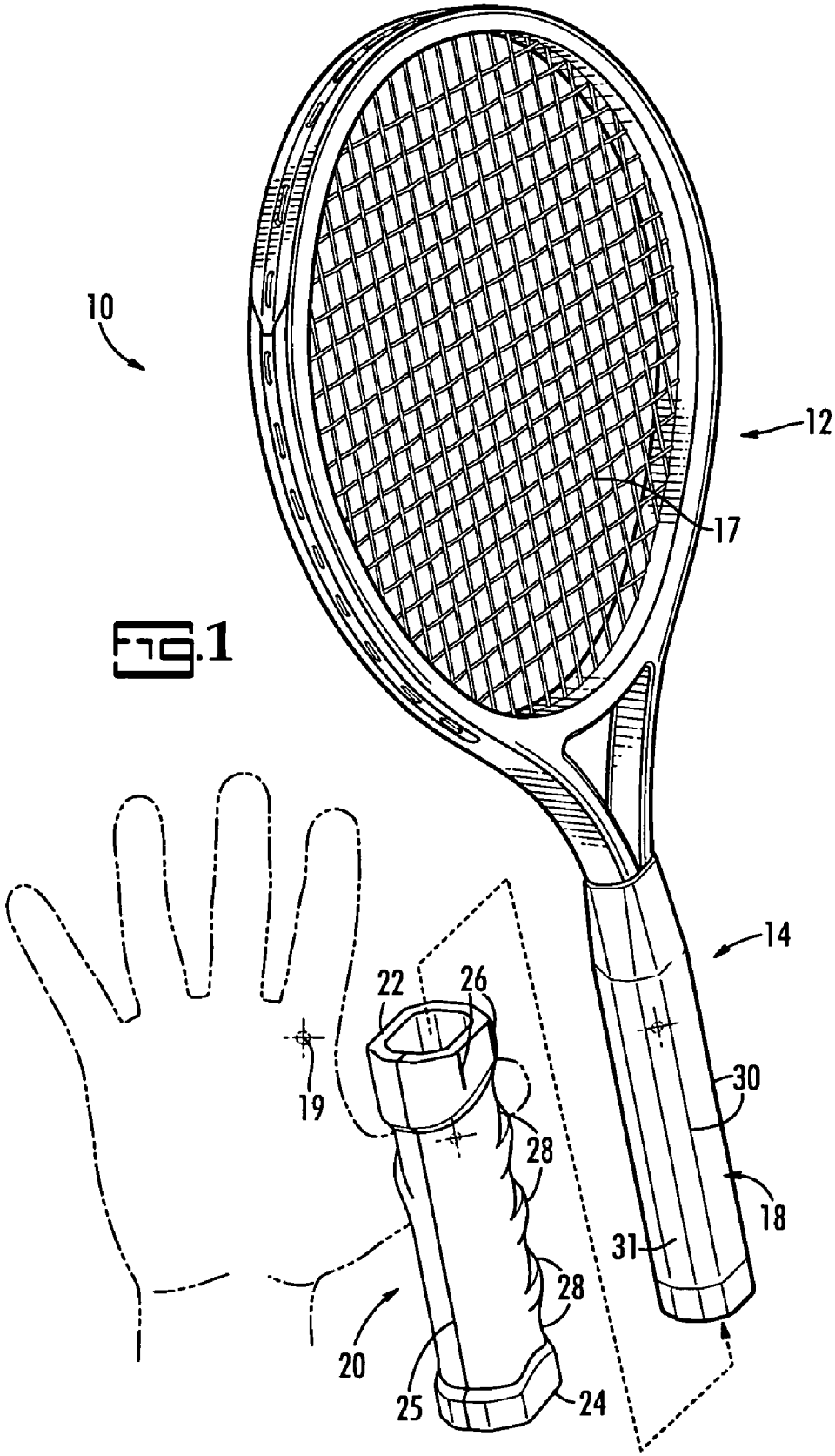
FIG. 1 shows a side view of the grip and illustrates placement of the grip onto the existing grip of a tennis racquet handle and of a player's right hand onto the grip.

While not illustrated, the training grip will also be adapted for use by left-handed players by creating a mirror image of each of the embodiments described. It is further contemplated that the training grip can be adapted to any size tennis racquet so that it may be used to train adults or children.

DETAILED DESCRIPTION OF THE INVENTION

The present invention is a tennis racquet grip for teaching or training a tennis player on various hand positions used for holding a tennis racquet handle for tennis strokes. A tennis racquet handle may be cut or molded depending upon the material composing the frame. Manufactured tennis racquets are produced to have symmetrical handles which are octagonal in shape. The inventive training grip is adapted for use with a tennis racquet having such eight-sided handle. While tennis racquets are symmetrical, a top, bottom, left and right side may be recognized when the racquet is held for play.

On the eight-sided handle, the top side and bottom side oppose each other and are equal in size. The left side and right side are also of equal size to each other, but are wider than the top and bottom sides. The top, bottom, left and right sides are separated by four more sides equal in size to each other but smaller than the top, bottom, left and right sides. For clarity, the four smaller sides will be referred to as "bevels" and numbered 1-4. Bevel 1 is between the top side and right side of the racquet handle. Bevel 2 is between the right side and bottom side of the racquet handle. Bevel 3 is between the bottom side and left side of the racquet handle. Bevel 4 is between the left side and top side of the racquet handle.

The inventive training grip may be easily and removably installed by the tennis player onto the handle of a tennis racquet over an existing grip that is permanently affixed to the racquet. In the alternative, the player may permanently mount the training grip onto a racquet that he or she uses for practice. A grip adapted for use by a right-handed player is described and illustrated below. However, the grip may be adapted for use by a left-handed player by creating mirror images of the embodiments contemplated and described. The grip may also be adapted to any size tennis racquet for use by adults or children.

The training grip comprises an elongated cup composed of a thin, flexible material and is installed onto the handle of a tennis racquet. Being cup shaped, the training grip has a first end that is open and adapted to wrapping around the end of the tennis racquet handle near the face of the racquet when the training grip is installed onto said tennis racquet handle. The outer surface of the grip is molded to have contours that guide placement of the player's fingers and thumb onto the racquet handle. The training grip also has a second opposing end comprising the bottom of said cup, adapted to wrap around the opposing end of said tennis racquet handle. The training grip also has a first additional opening comprising a slit extending lengthwise completely through one side of the grip from said first end to said second opposing end and through the bottom of the grip to be used for installation of the training grip onto the tennis racquet handle, and a second additional opening located where the top of the player's thumb will be positioned on the tennis racquet handle.

Installation of the training grip onto a tennis racquet handle is achieved by the user prying apart the lengthwise slit opening that runs from the first end to the second opposing end of the grip and through the bottom of the grip. The two halves of the grip created by the slit are symmetrical and are dimensioned to wrap around the tennis racquet handle. Proper positioning of the training grip is achieved by aligning two lines permanently marked on the outer surface of said first end of the grip with, the edges on the tennis racquet that form the right side of the racquet handle. These lines may be referred to as "guidelines" or "match lines."

Ridges and depressions are molded into the outer surface training grip creating contours which guide the placement of the player's hand, fingers, and thumb on the racquet handle. A second additional opening is also formed in the side of the training grip that is positioned over the left side of the racquet where the player's thumb wraps around the racquet handle. This opening has an irregular oval shape and is dimensioned to allow a portion of the player's thumb to have contact with the original grip on the tennis racquet. This second additional opening assists in keeping the invention in place during use. The training grip is also kept in place during play by texturing molded into the inner surface of the grip that comes into contact with the original grip on the tennis racquet handle.

Referring now to the drawings, FIG. 1 illustrates where a preferred embodiment used for training the Continental Forehand grip (20) is installed over the existing grip (18) permanently affixed to a tennis racquet handle (14) and how a player's hand (50) is positioned onto the grip once it has been installed onto the racquet. A tennis racquet (10) is comprised of a frame (12) that defines the racquet handle (14) and racquet face (16), strings (17) that are attached to the area of the frame that defines the racquet face and are woven to produce an area of the racquet for hitting a tennis ball, and at least one layer of material that is permanently affixed to the handle end of the racquet frame so that a tennis player can comfortably and securely hold onto the racquet, commonly referred to as a "grip" (18).

As further illustrated by FIG. 1, the inventive training grip (20) comprises an elongated cup having a first end (22) and a second opposing end (24). Being cup-shaped, the training grip is open at the first end as illustrated. The cup has a first additional opening comprising a slit (25) cut lengthwise through the cup from the first end of the cup (22) to the second opposing end (24), as shown. While not illustrated, the second opposing end of the training grip is formed to wrap around the bottom end of the tennis racquet handle (14). The slit (25) continues through the bottom of the grip. Installation of the inventive training grip (20) onto the tennis racquet handle (14) is achieved by the user prying open the slit (25) and wrapping the cup-shaped training grip (20) around the existing grip (18) that is permanently affixed to the tennis racquet handle (14). The user can confirm correct positioning of the training grip (20) on the existing grip carried on the tennis racquet handle (10) by referring to the two match lines (26) permanently marked on the outer surface of the first end (22) of the grip near the open end of the cup. Proper installation of the training grip is confirmed by aligning said match lines (26) with the edges (30) of the right side of the racquet handle (31).

The outer surface of the training grip (20) is molded to have ridges and depressions creating contours (28) adapted to receive the player's hand, fingers and thumb. The contours (28) guide placement of the player's hand, fingers and thumb onto the racquet into the correct grip position for the particular stroke taught or trained by the training grip. A training grip having contours (28) for guiding the player's hand, fingers, and thumb into correct position for the Continental Forehand grip is illustrated in FIG. 1. In some embodiments, contours (28) to receive both of the player's hands are molded into the outer surface of the training grip, such as for teaching and training the Two-Handed Backhand grip.

FIG. 1 also illustrates where the knuckle at the base of the player's index finger (19) will be positioned on the grip (20) and tennis racquet handle (14) when the player positions his or her hand, fingers and thumb into the contours of the training grip (20) by matching the small hatched circle and cross-lines. Although a training grip molded for a right-handed tennis player is shown, other embodiments of the training grip may be molded to have contours for left-handed players.

Figures 2A, 2B, 2C, 2D, 2E:
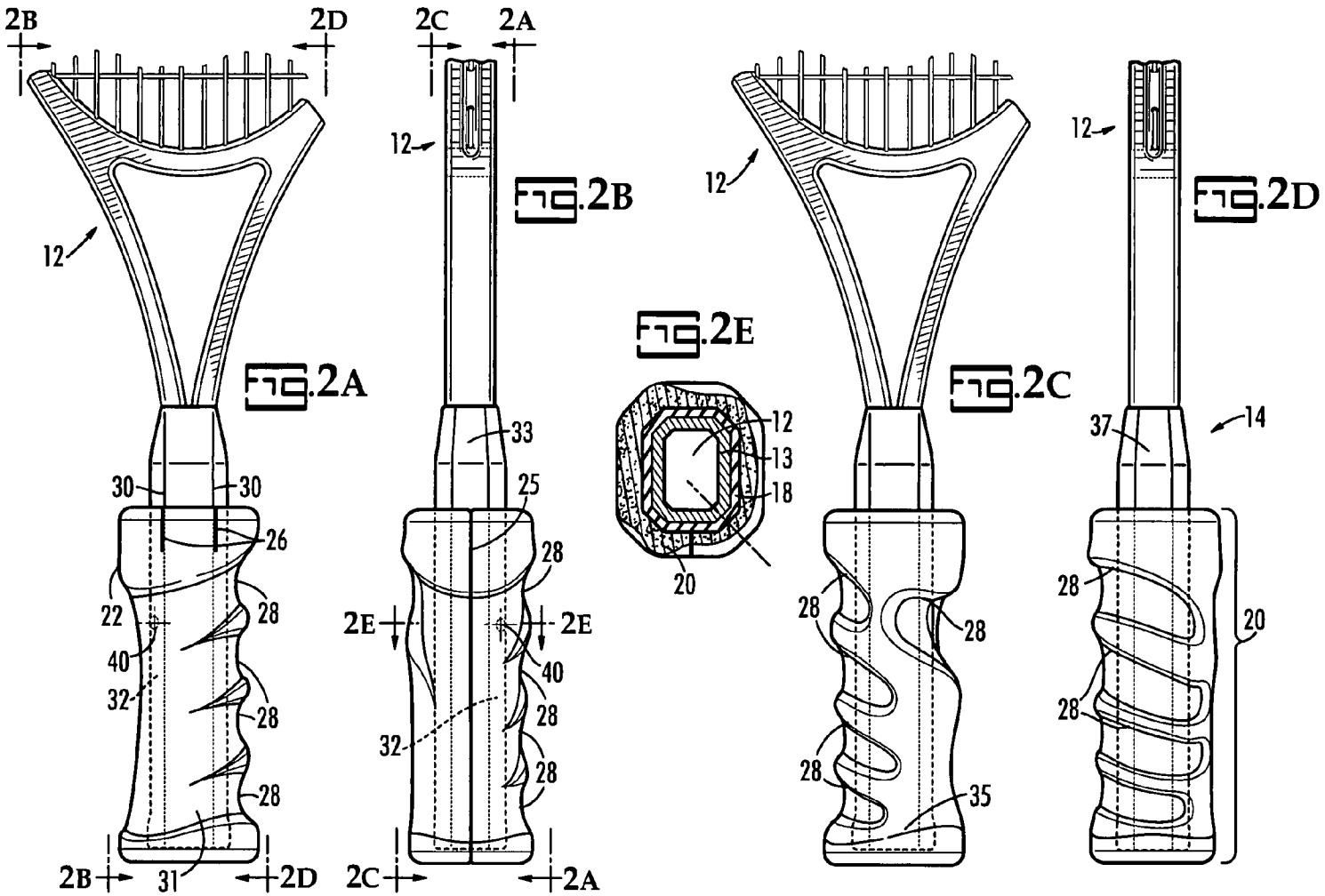
FIG. 2A is a view of the right side of a tennis racquet having a preferred embodiment of the present invention used for training a right-handed tennis player the Continental Forehand grip installed onto the racquet handle for use and illustrates the ridges and depressions molded into the outer surface of the inventive grip that form the contours which guide placement of the player's fingers and the match lines used to ensure proper placement of the invention onto the racquet handle.
FIG. 2B is a view of the top side of a tennis racquet having a preferred embodiment of the present invention used for training a right-handed tennis player the Continental Forehand grip installed onto the racquet handle for use, and further illustrates the opening used for installation of the training grip onto the tennis racquet handle.
FIG. 2C is a view of the left side of a tennis racquet having the preferred embodiment of the present invention used for training a right-handed tennis player the Continental Forehand grip installed onto the racquet handle for use.
FIG. 2D is a view of the bottom side of the tennis racquet having a preferred embodiment of the present invention used for training a right-handed tennis player the Continental Forehand grip installed onto the racquet handle for use, and further illustrates the contours which guide placement of the player's fingers on the racquet handle.
FIG. 2E is a cross-sectional view of the tennis racquet handle illustrating the construction of the tennis racquet handle and a preferred embodiment of the invention used for training a right-handed tennis player the Continental Forehand grip installed on the racquet for use.

FIGS. 2A through 2E illustrate several views of a preferred embodiment of the present invention installed on the handle (14) of a tennis racquet (10). In FIG. 2A, a view of the right side (31) of a tennis racquet handle (14) having a preferred embodiment of the present invention (20) used for training the Continental Forehand grip installed onto the racquet handle for use is shown. Position of the racquet handle (14) under the installed training grip is illustrated by hatched lines included in FIGS. 2A through 2D.

Ridges and depressions molded into the outer surface of the inventive grip (20) forming the contours (28) which guide placement of the player's hand, fingers and thumb are also shown in FIG. 2A. Also shown are the guidelines or match lines (26) permanently marked on the outer surface of the training grip (20) which the player can align with the edges (30) forming the right side (31) of the tennis racquet handle (14) to ensure proper and consistent placement of the training grip (20) onto the racquet handle (14).

FIG. 2B is a view of the top side (33) of a tennis racquet handle having a preferred embodiment of the present invention used for training the Continental Forehand grip (20) installed onto the racquet handle for use, and further illustrates the opening (25) used for installation of the training grip (20) onto the tennis racquet handle (14). The ridges and depressions molded into the outer surface of the inventive grip (20) forming the contours (28) which guide placement of the player's hand, fingers and thumb are also shown in this drawing. FIG. 2B further illustrates the slit-shaped opening (25) through which the training grip may be installed onto the racquet by the player prying open the training grip and placing it onto the tennis racquet handle (14) over the existing grip (18) carried on the handle. Said slit is made completely through the side of the training grip as shown and continues through the bottom of the drip.

A small circle with cross-lines (40) shown on Bevel 1 (32) in FIGS. 2A and 2B indicates the position of the knuckle of the player's right index finger (19) on the right side of the racquet handle (31) as shown in FIG. 2A and on the top side of the racquet handle (33) as shown in FIG. 2B when the player holds the training grip on the tennis racquet handle. The area of the racquet giving rise to the cross sectional view shown in FIG. 2E is also denoted by lines included in FIG. 2B. FIG. 2E will be discussed in detail below. References to the views of FIGS. 2B and 2D are also shown in FIG. 2A, to clarify the views shown in those Figures.

FIG. 2C shows the left side (35) of a tennis racquet handle (14) having the preferred embodiment of the present invention used for training the Continental Forehand grip (20)

installed onto the racquet handle (14) for use. This view shows the contours (28) molded into the outer surface of the inventive grip (20) where the tips of the player's fingers and thumb are positioned when holding the training grip on the racquet for play.

FIG. 2D is a view of the bottom side (37) of the tennis racquet handle (14) having a preferred embodiment of the present invention used for training the Continental Forehand grip (20) installed onto the racquet handle (14) for use. This view shows the contours (28) molded into the outer surface of the grip (20) used to position the player's fingers and thumb when holding the training grip installed on the racquet for play.

FIG. 2E shows a cross-sectional view of the tennis racquet handle (14) having a preferred embodiment of the present invention used for training the Continental Forehand grip (20) installed onto the racquet handle (14) for use. The handle illustrated in FIG. 2E is composed of three layers. The first layer is a core racquet frame (12) having an octagonal symmetrical shape. The core frame carries a second layer (13) on the handle portion of the frame which further defines the portion of the racquet handle held in the player's hand and is denoted on FIG. 2E by thin diagonal lines. This second layer is dimensioned to make the racquet easier to hold onto and use for the play of tennis. A grip, preferably composed of a flexible natural material such as leather or a synthetic material having similar characteristics (18) is permanently affixed to the outside of the second layer to make the racquet more comfortable to be held and to increase the security of the player's grip on the racquet handle. The grip is denoted by the area marked with bold diagonal lines. This existing grip on the racquet handle may or may not be perforated or scored.

As shown in FIG. 2E, the inventive training grip (20) is installed onto the racquet handle directly over the existing grip (18). As shown by the lines included in FIG. 2B denoting the location of the cross section pictured in FIG. 2E, the contour which guides placement of the player's hand and index finger onto the training grip is illustrated by the hatch-lined and dotted area (28). The upper portion of the training grip that is positioned above the player's hand and therefore not contoured is illustrated by the area free of any markings in FIG. 2E.

FIGS. 3A through 3E illustrate several views of an alternative preferred embodiment of the present invention installed on the handle (14) of a tennis racquet. These are the same views of the tennis racquet shown in FIGS. 2A through 2E with a preferred embodiment of the present invention used for training the Eastern Backhand grip installed onto the racquet handle for use, as will be explained below. The position of the racquet handle under the installed training grip is illustrated by hatched lines included, in FIGS. 3A through 3D.

Figures 3A, 3B, 3C, 3D, 3E:
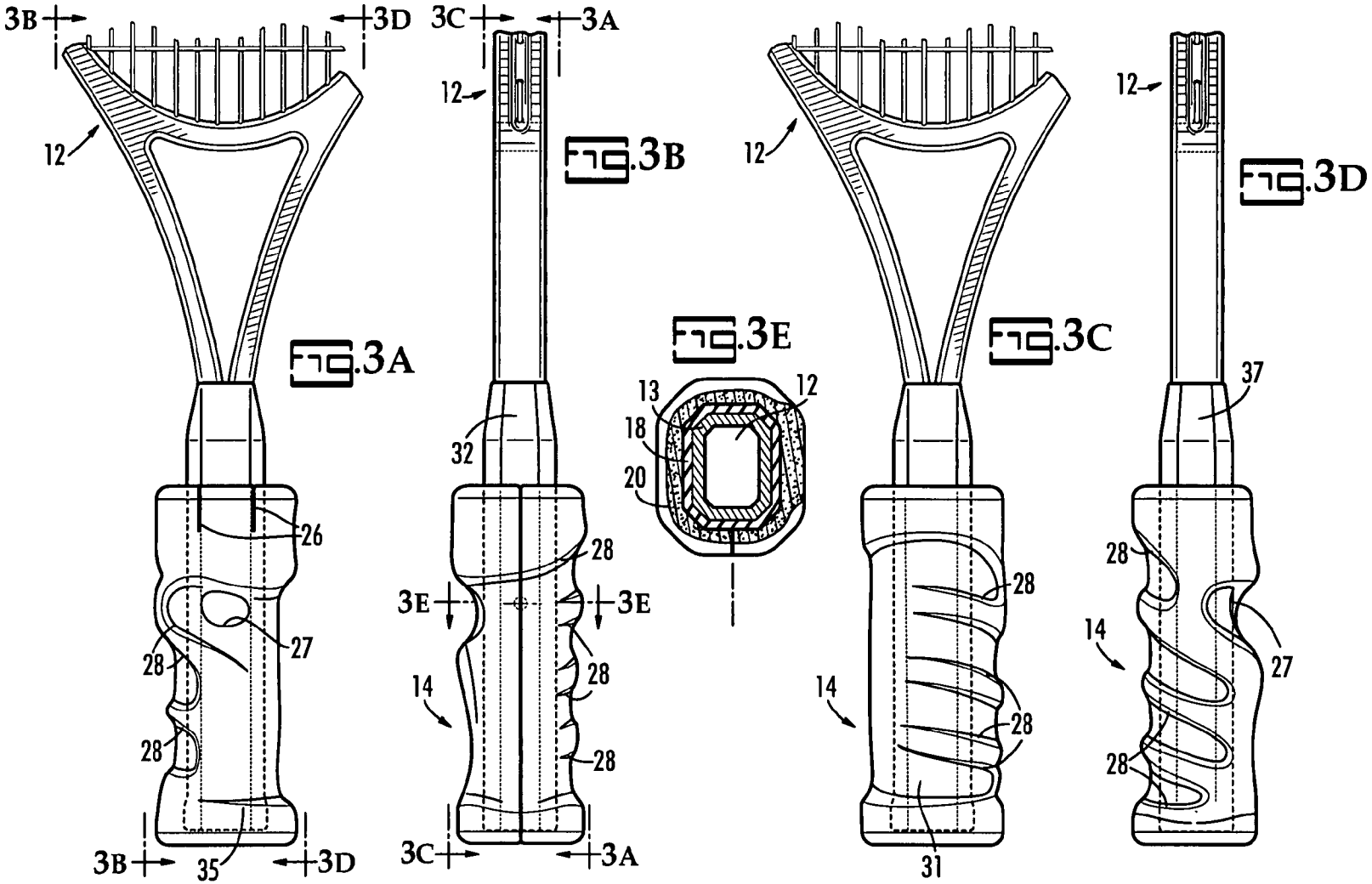
FIG. 3A is a view of the left side of a tennis racquet having a preferred embodiment of the present invention used for training a right-handed tennis player the Eastern Backhand grip installed onto the racquet handle for use and illustrates the ridges and depressions molded into the outer surface of the inventive grip that form the contours which guide placement of the player's fingers, guide lines or match lines used to ensure proper placement of the invention onto the racquet handle, and an opening created in the invention to allow the player's thumb to contact the existing grip.
FIG. 3B is a view of the top side of a tennis racquet having a preferred embodiment of the present invention used for training a right-handed tennis player the Eastern Backhand grip installed onto the racquet handle for use, and further illustrates the opening used for installation of the training grip onto the tennis racquet handle.
FIG. 3C is a view of the right side of a tennis racquet having the preferred embodiment of the present invention used for training a right-handed tennis player the Eastern Backhand grip installed onto the racquet handle for use.
FIG. 3D is a view of the bottom side of the tennis racquet having a preferred embodiment of the present invention used for training a right-handed tennis player the Eastern Backhand grip installed onto the racquet handle for use, and further illustrates the contours which guide placement of the player's fingers on the racquet handle.
FIG. 3E is a cross-sectional view of the tennis racquet handle illustrating the construction of the tennis racquet handle and a preferred embodiment of the invention used for training a right-handed tennis player the Eastern Backhand grip installed on the racquet for use.

FIG. 3A is a view of the left side of a tennis racquet having a preferred embodiment of the present invention used for training the Eastern Backhand grip (20) installed onto the racquet handle (14) for use. Also shown are guide lines or match lines (26) permanently marked on the outer surface of the training grip (20) which the player can align with the edges (30) forming the left side (35) of the tennis racquet handle (14) to ensure proper and consistent placement of the training grip (20) onto the racquet handle (14). This view also illustrates the second additional opening in the grip (27), which is an irregular oval in shape and dimensioned to allow the player's thumb to directly contact the existing grip permanently affixed to said tennis racquet handle. References to the views of FIGS. 3B and 3D are also shown in FIG. 3A, to clarify the views of the tennis racquet shown in those respective Figures.

FIG. 3B is a view of the top side of a tennis racquet having a preferred embodiment of the present invention used for training the Eastern Backhand grip (20) installed onto a tennis racquet handle (14) for use. The contours (28) molded into the outer surface of the inventive grip (20) which guide placement of the player's hand, fingers and thumb are also shown in this drawing. FIG. 3B further illustrates the first additional opening, a slit (25), through which the training grip may be installed onto the racquet by the player prying open the training grip and placing it onto the tennis racquet handle (14). Said slit is made completely through the side of the training grip as shown and continues through the bottom of the drip. When installed onto the racquet, the cup-shaped bottom of the training grip is dimensioned to wrap around the end of the racquet handle.

A small hatched circle with cross-lines (40) is shown on the top side of the racquet handle in FIG. 3B to denote placement of the knuckle of the player's index finger, as illustrated in FIG. 1 (19), on the inventive grip when the player holds the training grip installed on a tennis racquet handle. FIG. 3B also includes lines which clarify the location of the cross sectional view pictured in FIG. 3E. FIG. 3E will be discussed in detail below. References to the views of FIGS. 3A, 3C, and 3E are also shown in FIG. 3B, to clarify the views of the tennis racquet shown in those respective Figures.

FIG. 3C shows the right side (31) of a tennis racquet handle having the preferred embodiment of the present invention used for training the Eastern Backhand grip (20) installed onto the racquet handle (14) for use. This view shows the contours (28) molded into the outer surface of the inventive grip (20) where the player's fingers are positioned when holding the training grip on the racquet for play.

FIG. 3D is a view of the bottom side (37) of the tennis racquet handle (14) having a preferred embodiment of the present invention used for training the Eastern Backhand grip (20) installed onto the racquet handle (14) for use. This view shows the contours (28) molded into the outer surface of the grip (20) where the tips of the player's fingers and thumb are positioned when holding the training grip installed on the racquet for play. Also shown is a small portion of the second additional opening in the grip (27), where the player's thumb directly contacts the existing grip permanently affixed to said tennis racquet handle.

FIG. 3E shows a cross-sectional view of the tennis racquet handle (14) having a preferred embodiment of the present invention used for training the Eastern Backhand grip (20) installed onto the racquet handle (14) for use. The handle illustrated in FIG. 2E has a dual layer construction. The first layer is a core racquet frame (12) having an octagonal symmetrical shape. The core frame carries a second layer (13) on the handle portion of the frame which further defines the portion of the racquet handle held in the player's hand and is denoted on FIG. 2E by thin diagonal lines. A grip, preferably composed of a flexible natural material such as leather or a synthetic material having similar characteristics (18) is permanently affixed to the outside of the second layer to make the racquet more comfortable to be held and to increase the security of the player's grip on the racquet handle. This existing grip on the racquet handle may or may not be perforated or scored.

As shown in FIG. 3E, the inventive training grip (20) is installed onto the racquet handle directly over the existing grip (18). The contours which guides placement of the player's hand and index finger onto the training grip is illustrated by the hatch-lined and dotted area (20) on the handle. The upper portion of the training grip that is positioned above the player's hand and is therefore not contoured is illustrated by the area free of all hatch lines in FIG. 3E.

Although not illustrated, alternative embodiments of the inventive training grip used for teaching and training proper hand positioning for one or both of a player's hands are also contemplated. Such embodiments include the Semi-Western Forehand and Western Forehand, which are one-handed forehand grips, the One-Handed Backhand, in which the player performs a backhand stroke while holding the tennis racquet handle with one hand, and the Two-Handed Backhand, in which the player performs a backhand stroke while holding the tennis racquet in both of hands. It is further contemplated that all embodiments of the training grip will be produced for right-handed and left-handed tennis players, and in different sizes to accommodate players of all ages and hand sizes.

It is intended that the scope of the present invention include all modifications that incorporate its principal design features, and that the scope and limitation of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art of tennis racquet training grips from the foregoing description of the preferred embodiments without departing from the spirit or scope of the present invention.

What is claimed is:

1. A training grip dimensioned to be removably installed onto the handle of a tennis racquet for positioning one or both of a tennis player's hand on the racquet to teach or train the player on several methods commonly used to grip the tennis racquet to perform various tennis strokes comprising:

a) a member in the shape of an elongated cup having a first end that is open and a second opposing end forming the bottom of said cup, said first end, when said member is installed onto said tennis racquet handle, being locatable near the face of said tennis racquet and said second end being locatable at the opposing end of said tennis racquet handle;

b) at least two additional openings, a first additional opening adapted to allow the user to easily and removably install the training grip onto said tennis racquet handle by prying open said training grip and wrapping it around said tennis racquet handle, and a second additional opening adapted to allow the player's thumb to directly contact the existing grip permanently affixed to said tennis racquet handle;

c) texturing molded into the inner surface of the cup to keep the grip from slipping on the tennis racquet handle during play; and d) ridges and depressions molded into the outer surface of said elongated cup member creating contours for receiving and guiding the player's hand or hands, fingers and one or both of the player's thumbs on the tennis racquet handle.

2. The training grip of claim 1, wherein said grip is composed of a flexible, rubber-like material that is moldable.

3. The training grip of claim 1, wherein said first additional opening comprises a slit cut lengthwise completely through one side of said elongated cup member, from said first end of said member to said second end, and also completely through the bottom of said member.

4. The training grip of claim 1, wherein said additional second opening comprises an irregularly-shaped oval opening locatable near said first end of said elongated cup member and dimensioned to allow the thumb, when the player is holding the tennis racquet handle in one hand, to contact said existing grip on said tennis racquet handle.

5. The training grip of claim 1, wherein said ridges and depressions are molded into said outer surface of said grip and dimensioned to receive and position the player's right hand, fingers, and thumb onto said handle of said tennis racquet to teach and/or train the player as to the correct positioning for one of several methods used to grip a tennis racquet to achieve strokes used during the play of tennis.

6. The training grip of claim 5, further comprising two guide lines or match lines permanently marked on the outer surface of said first end of said grip, said lines adapted to align with the edges of the right side of the tennis racquet handle.

7. The training grip of claim 1, wherein said ridges and depressions are molded into said outer surface of said grip and dimensioned to receive and position the player's left hand, fingers, and thumb onto said handle of said tennis racquet to teach and/or train the player as to the correct positioning for one of several methods used to grip a tennis racquet to achieve strokes used during the play of tennis.

8. The training grip of claim 7, further comprising two lines permanently marked on the outer surface of said first end of said grip, said lines adapted to align with the edges of the left side of the tennis racquet handle.

9. The training grip of claim 1, wherein said ridges and depressions are molded into said outer surface of said grip and dimensioned to receive and position the fingers and thumbs of both of the player's hands onto said handle of said tennis racquet to teach and/or train the player as to the correct positioning for one of several methods used to grip a tennis racquet with both hands to achieve strokes used during the play of tennis.

10. The training grip of claim 9, further comprising two lines permanently marked on the outer surface of said first end of said grip, said lines adapted to align with the edges of the right side of the tennis racquet handle on a grip for a right-handed player who will place his or her first end of said grip, or the left side of the will place his or her left hand nearer to said first end of said grip than his or her right hand.

* * * * *